United States Patent [19]

Dobbs

[11] Patent Number: 4,732,100

[45] Date of Patent: Mar. 22, 1988

[54] ACTUATION SYSTEM FOR TORPEDO CONTROL SURFACES

[75] Inventor: Daniel R. Dobbs, Sunnyvale, Calif.

[73] Assignee: Sundstrand Corporation, Rockford, Ill.

[21] Appl. No.: 944,927

[22] Filed: Dec. 22, 1986

[51] Int. Cl.[4] ..... F42B 19/01

[52] U.S. Cl. ..... 114/23; 114/144 R

[58] Field of Search ..... 114/23, 21.1, 20.1, 114/21.2; 244/3.21, 3.24; 114/144 R, 152

[56] References Cited

U.S. PATENT DOCUMENTS

| | | | |
|---|---|---|---|
| 1,098,230 | 5/1914 | Dallier | 114/23 |
| 2,906,227 | 9/1959 | Smith | 114/23 X |
| 4,228,739 | 10/1980 | Fitzgibbon | 403/286 X |
| 4,356,786 | 11/1982 | Tuggle | 114/280 |
| 4,531,921 | 7/1985 | Teraura et al. | 114/144 R X |

FOREIGN PATENT DOCUMENTS

| | | | |
|---|---|---|---|
| 326868 | 10/1920 | Fed. Rep. of Germany | 114/23 |

*Primary Examiner*—David H. Brown

*Attorney, Agent, or Firm*—Wood, Dalton, Phillips, Mason & Rowe

[57] ABSTRACT

An interior actuation system for controlling an exterior control surface of a torpedo or the like which has an afterbody with radial inlet vanes defining inlet liquid passages to the propellers of the torpedo. A linear actuator is mounted in the afterbody. A bell crank is connected at one end to the linear actuator and extends radially outwardly therefrom through one of the inlet vanes. A driving connection, including a link arm connected at one end to the opposite end of the bell crank, extends longitudinally from the bell crank through the afterbody outside the liquid passages and operatively interconnects the control surface to the linear actuator.

17 Claims, 3 Drawing Figures

ACTUATION SYSTEM FOR TORPEDO CONTROL SURFACES

FIELD OF THE INVENTION

This invention relates to an interior actuation system for controlling an exterior control surface, such as a steering fin, of a torpedo or the like.

BACKGROUND OF THE INVENTION

Torpedoes or other similar power propelled vessels normally are provided with exterior control surfaces, such as fins, rudders or keels for controlling the direction of movement of the vessels. Such exterior control surfaces conventionally are mounted on and exteriorly of the afterbody or rear end of the torpedo. Remote or sensor controlled actuation systems are disposed interiorly of the torpedo, usually in the afterbody, for actuating or controlling movement of the control surfaces to steer the torpedo.

Various problems are encountered in interconnecting the interior actuation system with the exterior control surface. Space always is at a premium and must be considered in designing the torpedo. Therefore, the problem of packaging constantly is present. In addition, a mechanically quiet actuation mechanism is of obvious and important concern. On the other hand, a problem which is not often addressed is that of insuring a minimum wake in the entrance and exit flow regions of the torpedo propellers. In other words, the propellers conventionally are mounted in or at the rear end of the afterbody. The control surfaces or rudders are most effective in the same area, but exteriorly of the afterbody. Consequently, the mechanical connections or linkages between the interior actuation system and the exterior control surfaces often interfere with a smooth flow of liquid into and through the area of the torpedo propellers.

Examples of various systems for controlling the rudders of torpedoes are shown in U.S. Pat. Nos. 883,028 to Jones, dated Mar. 24, 1908; 1,659,653 to Hammond, Jr. et al, dated Feb. 21, 1928; 2,568,433 to Daly et al, dated Sept. 18, 1951; 2,795,201 to Fogarty et al, dated June 11, 1957; 3,608,509 to Brooks dated Sept. 28 1971; 3,645,223 to Whitener, dated Feb. 29, 1972; and 4,391,474 to Martini, dated July 5, 1983. These patents clearly show the complexity of some prior actuation systems of the character described and, in fact, some of the patents illustrate that the problem of minimizing wake to the torpedo propellers is not even given consideration.

This invention is directed to providing a vastly simplified actuation system for interiorly controlling an exterior control surface of a torpedo or the like, in which the system minimizes space requirements, is mechanically quiet and does not interfere or cause wakes in the entrance and exit flow regions of the torpedo propellers.

SUMMARY OF THE INVENTION

An object, therefore, of the invention is to provide a new and improved interior actuation system for controlling an exterior control surface, such as a steering fin of a torpedo or the like.

The torpedo illustrated herein has a longitudinal axis through the torpedo and into an afterbody which is provided with radial inlet vanes defining inlet liquid passages to the propellers of the torpedo in the afterbody.

The invention generally contemplates linear actuation means in the afterbody and movable in the longitudinal direction. Crank means are connected, at one end, to the linear actuation means and extend radially outwardly therefrom through one of the inlet vanes. One end of a link means is connected to the opposite end of the crank means and extend longitudinally therefrom through the afterbody outside the liquid passages. Drive means on the opposite end of the link means are coupled to the exterior control surface for actuating the control surface.

In order to completely eliminate any interference with or wakes in the liquid flow through the passages to the torpedo propellers, the crank means is disposed within and extends radially outwardly through one of the inlet vanes which define the liquid passages. The vanes are quite thin and the crank means is very thin in their cross-dimensions relative to their dimensions in the direction of flow through the liquid passages. The crank means comprise a bell crank pivotally mounted intermediate its ends inside the one inlet vane. The crank means are connected at opposite ends to the actuation means and to the link means by joint means which include self-lubricating, noise attenuating material.

The drive means include a gear rack on the aforesaid opposite end of the link means in mesh with a pinion gear coupled to the exterior control surface. The pinion gear is fixed to a stub shaft extending to the exterior of the afterbody and secured to the control surface for rotating the control surface. The link means and the stub shaft are surrounded by self-lubricating, noise attenuating material.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
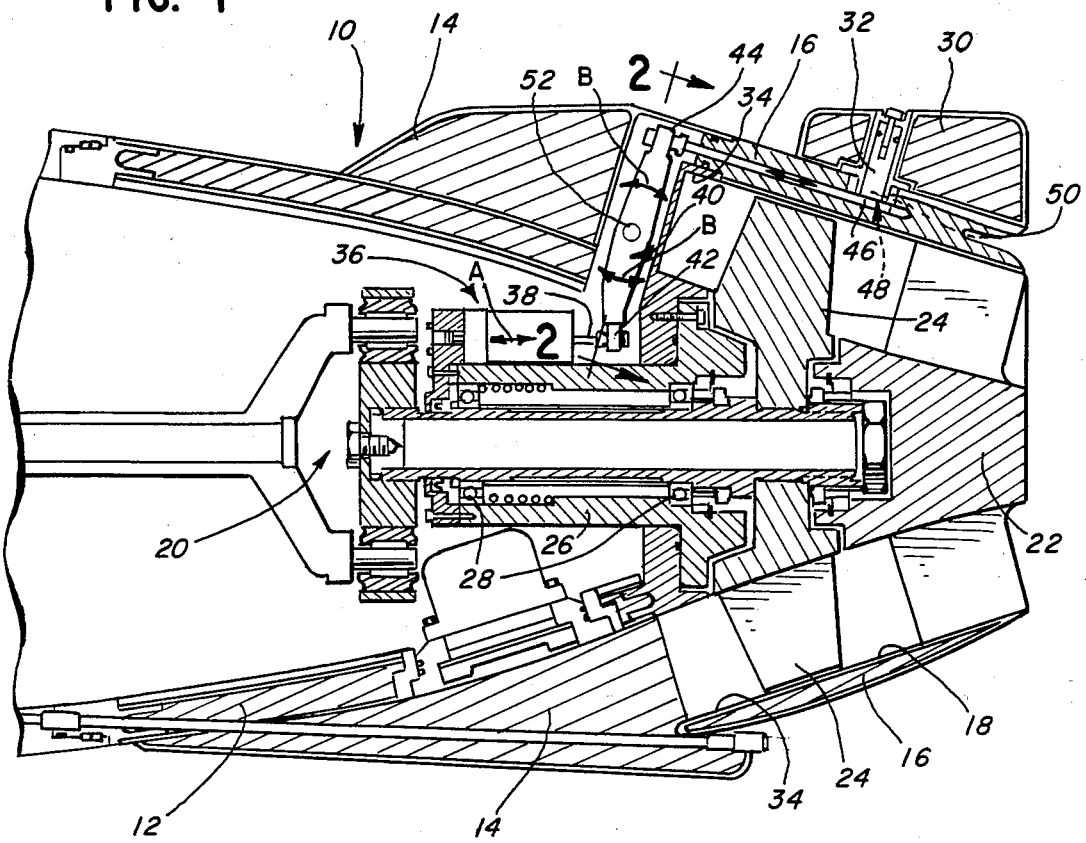
FIG. 1 is an axial section through the afterbody of a torpedo incorporating the actuation system of the invention.

Referring to the drawings in greater detail, and first to FIG. 1, the interior actuation system of this invention is illustrated for mounting within a torpedo afterbody, generally designated 10, which includes a hull 12 and a plurality of support vanes 14 disposed angularly about the hull, along with a rear shroud 16 which defines a propeller chamber 18. Drive shaft means, generally designated 20, extend rearwardly through the propeller along a longitudinal axis 22 from the forward motive means (not shown) of the torpedo. Propellers 24 are appropriately fixed to the rear distal end of drive shaft means 20 whereby the propellers are rotated about longitudinal axis 22 by the torpedo motive means. An interior, cylindrical housing 26 surrounds the rear end of shaft means 22, and appropriate bearings 28 are provided between the housing and the drive shaft means One or more exterior control surfaces, such as rudders or steering fins 30, are rotatably mounted on the outside of shroud 16 by a stub shaft 32. As is known, rotation of the steering fins control the direction of movement of the torpedo.

Figure 2:
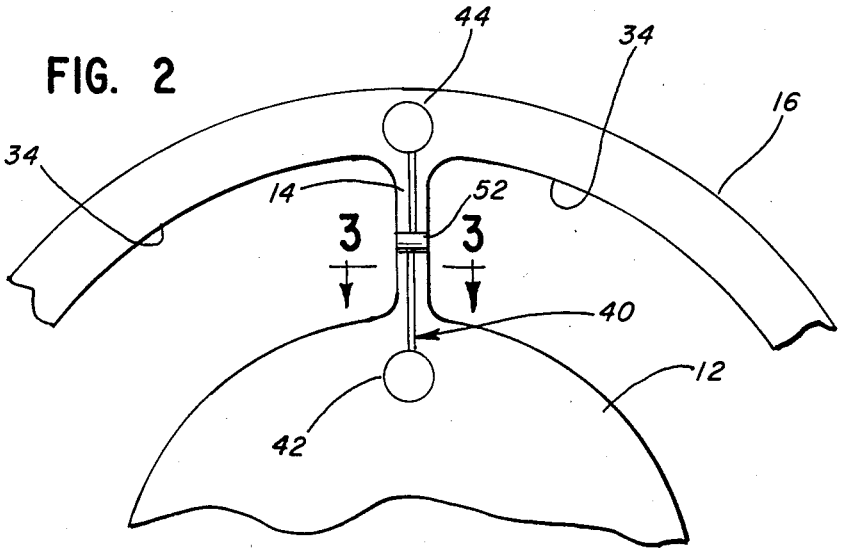
FIG. 2 is a fragmented vertical section, on an enlarged scale, taken generally along line 2—2 of FIG. 1.

As illustrated in FIG. 2, radial inlet vanes 14 extend between hull 12 and shroud 16 and define a plurality of inlet liquid passages 34 (also see FIG. 1) which lead to propellers 24 in propeller chamber 18 of shroud 16. The radial inlet vanes are designed to be narrow or thin in their cross dimensions relative to their dimensions in the direction of flow of the liquid through passages 34. These parameters are important in order to minimize interference with or wakes in the smooth flow of liquid to the propellers. In addition, the radial inlet vanes "straighten out" the flow path of the liquid which may be somewhat turbulent outside of the torpedo and forwardly of the inlet vanes.

The interior actuation system of the invention includes linear actuation means, generally designated 36 (FIG. 1), which has a piston rod-like component 38 within the afterbody movable in the longitudinal direction as indicated by double-headed arrow "A". The linear actuation means may be a motor, solenoid or the like which may be remotely controlled or sensor controlled, such as by radar, heat or the like.

Crank means in the form of a bell crank, generally designated 40, is connected at one end 42 to the distal end of rod 38. The bell crank extends radially outwardly and its opposite end 44 is connected to the forward end of a link means in the form of a link arm 46. Link arm 46 extends rearwardly from the opposite end of bell crank 40, longitudinally therefrom, through shroud 16 of the torpedo afterbody outside fluid passages 34.

Link arm 46 has a gear rack formed on one side thereof, as at 48 (the backside as viewed in the drawings), for meshing with a pinion gear 50 fixed to the lower distal end of stub shaft 32 for steering fin 30.

Generally, bell crank 40 is pivoted intermediate its ends 42,44 by a pivot pin 52. Therefore, as rod 38 linearly moves in the direction of double-headed arrow "A", this movement is effective to pivot bell crank 40 in the direction of double-headed arrows "B". Pivoting movement of the bell crank causes linear movement of link arm 46, along with its gear rack, in the direction of double-headed arrow "C". This movement effects rotation of pinion gear 50, stub shaft 32 and steering fin 30 in order to steer the direction of movement of the torpedo through its surrounding liquid, such as seawater.

From the foregoing, it can be seen that linear movement of actuation means 36 effects rotational movement of steering fin 30 by means of the pivotally mounted bell crank 40, linearly movable link arm 46 and the rack-and-pinion connection 48,50.

The invention contemplates the provision of noise attenuating means throughout the mechanical linkage circuit described above. More particularly, the connections at the ends 42,44 of bell crank 40 with piston rod 38 and link arm 46, respectively, are ball and socket joints. Either the ball or socket or both are lined with self-lubricating, noise attenuating material, such as a self-lubricating fabric bearing. In addition, link arm 46 and stub shaft 32 are surrounded by similar self-lubricating, noise attenuating material. Rack gear 48 and pinion gear 50 also are covered with or fabricated of self-lubricating, noise attenuating material. One example of such material would be Teflon.

Figure 3:
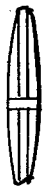
FIG. 3 is a horizontal section taken generally along line 3—3 of FIG. 2.

Referring to FIGS. 2 and 3 in conjunction with FIG. 1, an important feature of the invention is the location and construction of bell crank 40 which effectively interconnects linear actuation means 36 to link arm 46 leading to steering fin 30. In other words, the bell crank provides the operative connection between the interior actuation means which is located radially inwardly of the propellers and fluid passages 34 with the drive means for steering fin 30 which are located outside of the bounds of the propellers and the liquid passages.

More particularly, it can be seen that bell crank 40 extends radially outwardly through one of the inlet vanes 14. Pivot pin 52 for the bell crank is pivotally mounted cross-wise within the inlet vane. In this manner, and since the inlet vane itself is provided for smoothing and straightening out the flow of liquid through the passages, the effective driving connection (i.e. bell crank 40) between the interior actuation means and the exterior drive means does not in any way interfere with or cause wakes in the liquid flow.

It also can be seen in FIGS. 2 and 3 that vanes 14 are quite thin and bell crank 40 is very thin in their cross-dimensions relative to their dimensions (as seen in FIG. 1) in the direction of flowthrough liquid passages 34.

From the foregoing, it can be seen that the novel actuation system of this invention is extremely simple, very quiet and does not disturb flow of liquid to the torpedo propellers.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An interior actuation system for controlling an exterior control surface of a torpedo or the like which has a longitudinal axis, and an afterbody with radial inlet vanes defining inlet liquid passages to the propellers of the torpedo in the afterbody, comprising:

linear actuation means in the afterbody and movable in the longitudinal direction;

crank means connected at one end to the linear actuation means and extending radially outwardly therefrom through at least one of said inlet vanes;

link means connected at one end to the opposite end of the crank means and extending longitudinally therefrom through the afterbody outside the liquid passages; and drive means on the opposite end of the link means and coupled to the exterior control surface for actuating the control surface.

2. The actuation system of claim 1 wherein said crank means comprise a bell crank pivotally mounted intermediate its ends between the linear actuation means and the link means.

3. The actuation system of claim 1 wherein said crank means is connected at opposite ends to said actuation means and to said link means by joint means which include self-lubricating, noise attenuating material.

4. The actuation system of claim 1 wherein said link means is surrounded by self-lubricating, noise attenuating material.

5. The actuation system of claim 1 wherein said crank means is disposed within and extends radially outwardly through one of said inlet vanes.

6. The actuation system of claim 5 wherein said crank means comprise a bell crank pivotally mounted intermediate its ends inside said one inlet vane.

7. The actuation system of claim 1 wherein said crank means is very thin in its cross dimensions relative to its dimensions in the direction of flow through said passages.

8. The actuation system of claim 3 wherein said crank means is disposed within the extends radially outwardly through one of said inlet vanes.

9. The actuation system of claim 4 wherein said crank means comprise a bell crank pivotally mounted intermediate its ends inside said one inlet vane.

10. An interior actuation system for controlling an exterior control surface of a torpedo or the like which has an afterbody with radial inlet vanes defining inlet liquid passages to the propellers of the torpedo, comprising actuation means in the afterbody;

crank means connected at one end to the actuation means and extending radially outwardly therefrom through at least one of said inlet vanes; and means operatively connecting the opposite end of the crank means to the exterior control surface.

11. The actuation system of claim 10 wherein said crank means comprise a bell crank pivotally mounted intermediate its ends inside said one inlet vane.

12. The actuation system of claim 10 wherein said bell crank means is connected at opposite ends by joint means which include self-lubricating, noise attenuating material.

13. The actuation system of claim 10 wherein said crank means is very thin in its cross dimensions relative to its dimensions in the direction of flow through said passages.

14. The actuation system of claim 13 wherein said crank means comprise a bell crank pivotally mounted intermediate its ends inside said one inlet vane.

15. An interior actuating system for controlling an exterior control surface of a torpedo or the like which has an afterbody with radial inlet vanes defining inlet liquid passages to the propellers of the torpedo, comprising:

actuation means in the afterbody;

crank means connected at one end to the actuation means and extending radially outwardly therefrom through at least one of said inlet vanes, the crank means being very thin in cross-dimensions relative to its dimensions in the direction of flow through said passages; and means operatively connecting the oppossite end of the crank means to the exterior control surface.

16. The actuation system of claim 15 wherein said crank means comprise a bell crank pivotally mounted intermediate its ends within the afterbody.

17. The actuation system of claim 15 wherein said crank means is connected at opposite ends by joint means which include self-lubricating, noise attenuating material.

* * * * *